US010815543B2

(12) United States Patent
Chung et al.

(10) Patent No.: US 10,815,543 B2
(45) Date of Patent: Oct. 27, 2020

(54) QUENCHING APPARATUS

(71) Applicant: Won Ki Chung, Seoul (KR)

(72) Inventors: Soo Jin Chung, Seoul (KR); Ji-Young Kang, Incheon (KR); Dong-Ryeol Kim, Siheung-si (KR); Ki Woong Kim, Incheon (KR)

(73) Assignee: Won Ki Chung, Seoul (KR)

( * ) Notice: Subject to any disclaimer, the term of this patent is extended or adjusted under 35 U.S.C. 154(b) by 0 days.

(21) Appl. No.: 15/540,927

(22) PCT Filed: Feb. 16, 2017

(86) PCT No.: PCT/KR2017/001723
§ 371 (c)(1),
(2) Date: Jun. 29, 2017

(87) PCT Pub. No.: WO2018/124379
PCT Pub. Date: Jul. 5, 2018

(65) Prior Publication Data

US 2019/0360062 A1 Nov. 28, 2019

(30) Foreign Application Priority Data

Dec. 29, 2016 (KR) ..... 10-2016-0182374

(51) Int. Cl.
*C21D 1/62* (2006.01)
*C21D 1/613* (2006.01)
(Continued)

(52) U.S. Cl.
CPC ..... *C21D 1/62* (2013.01); *C21D 1/613* (2013.01); *C21D 1/767* (2013.01); *C21D 9/0025* (2013.01)

(58) Field of Classification Search
CPC ..... C21D 1/613; C21D 1/62; C21D 1/767; C21D 9/0025
(Continued)

(56) References Cited

U.S. PATENT DOCUMENTS 6,913,449 B2 * 7/2005 Loeser ..... C21D 1/613 266/250
9,365,909 B2 * 6/2016 Tissot ..... F27D 9/00

FOREIGN PATENT DOCUMENTS

CN 104011229 A 8/2014
EP 0535319 B1 6/1995
KR 20140098085 8/2014

OTHER PUBLICATIONS

Office Action issued by KIPO dated Apr. 25, 2018 for KR Serial No. 10-2016-0182374.
(Continued)

*Primary Examiner* — Jessee R Roe
*Assistant Examiner* — Michael Aboagye
(74) *Attorney, Agent, or Firm* — Harness, Dickey & Pierce, P.L.C.

(57) ABSTRACT

A quenching apparatus capable of quickly reversing a flow of cooling gas flowing in a chamber. The quenching apparatus includes: a chamber provided with a gas inlet and a gas outlet and having an object charged therein; a pair of flow generating means disposed on both sides of the chamber and generating a flow of gas in the chamber; and a flow direction reversing means disposed in the chamber and reversing a flow direction of gas to make the gas flow in any one of a first flow direction in which the gas flows from top to bottom of the object and a second flow direction in which the gas flows from the bottom to the top of the object.

7 Claims, 5 Drawing Sheets

(51) Int. Cl.
*C21D 1/767* (2006.01)
*C21D 9/00* (2006.01)

(58) Field of Classification Search
USPC ..... 266/207, 46, 44, 259, 251
See application file for complete search history.

(56) References Cited

OTHER PUBLICATIONS

Chinese Office Action (w/English translation) dated May 8, 2019 for corresponding Chinese Application No. 201780000697.4.

* cited by examiner

[Fig. 1]
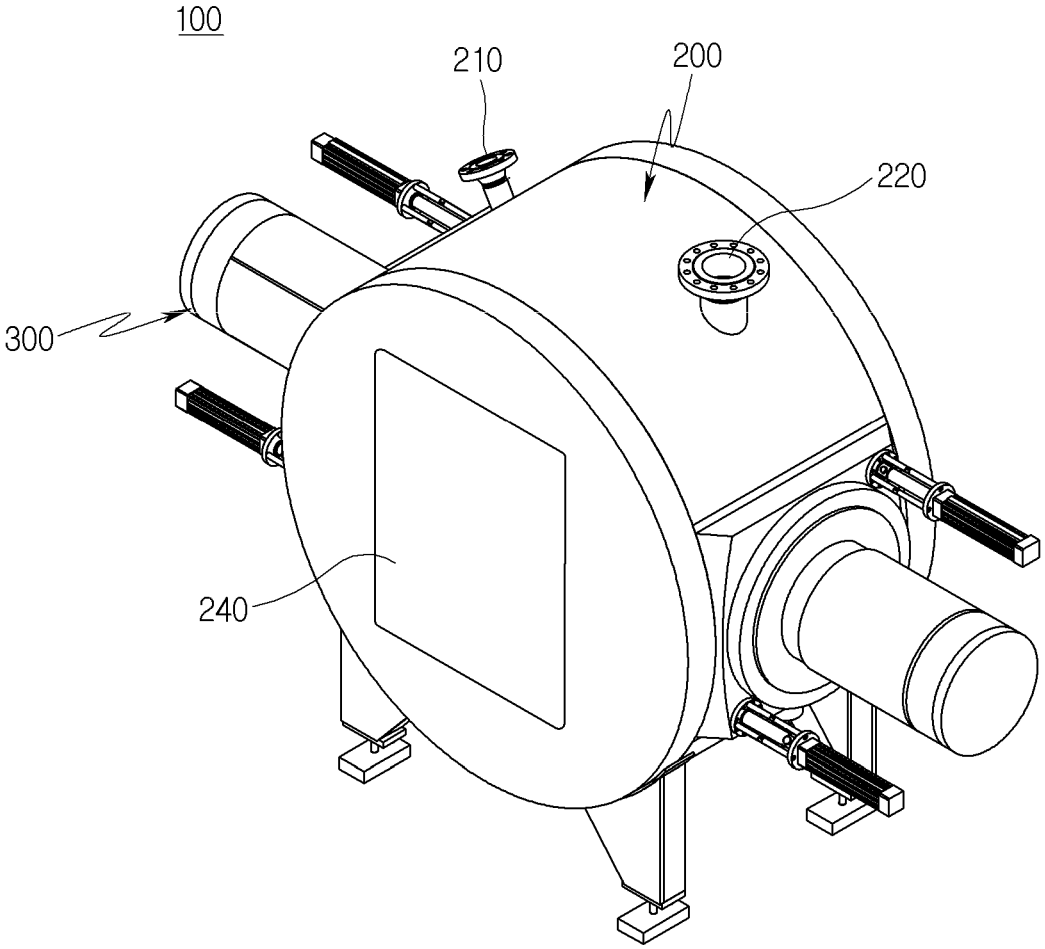

[Fig. 2]
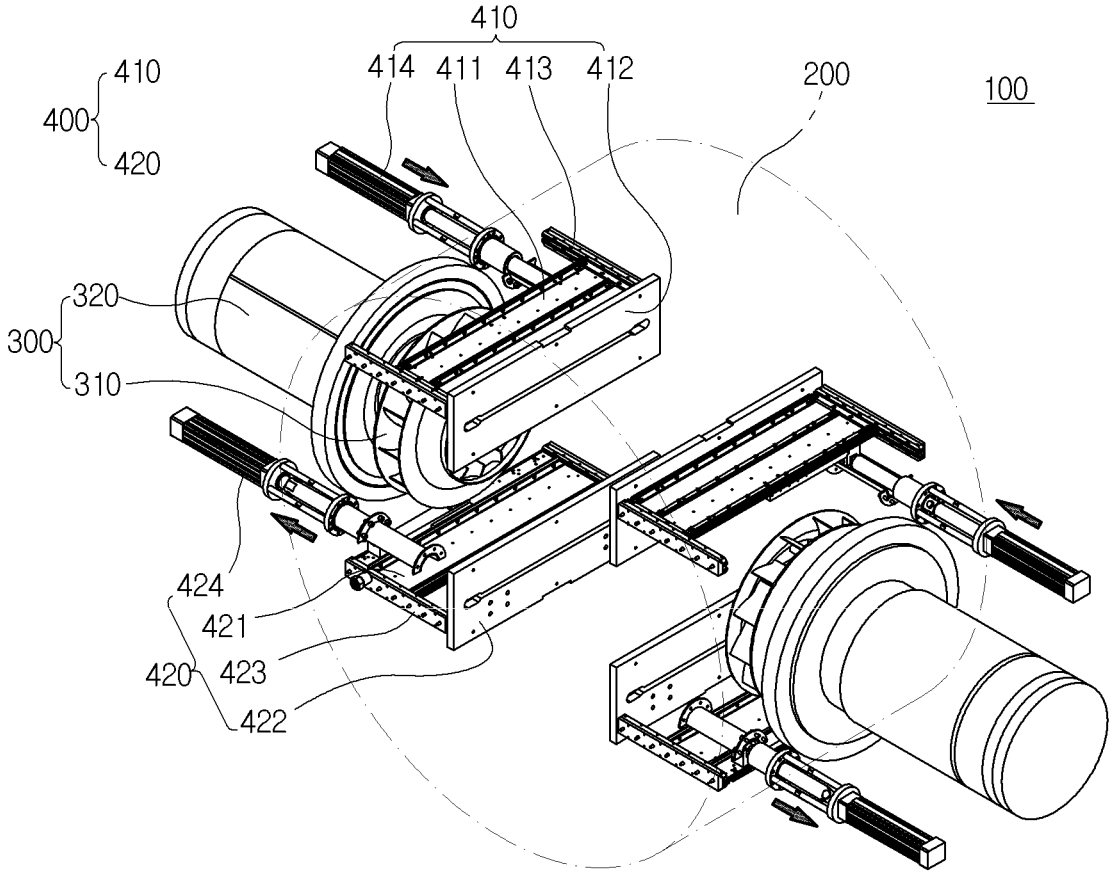

[Fig. 3]
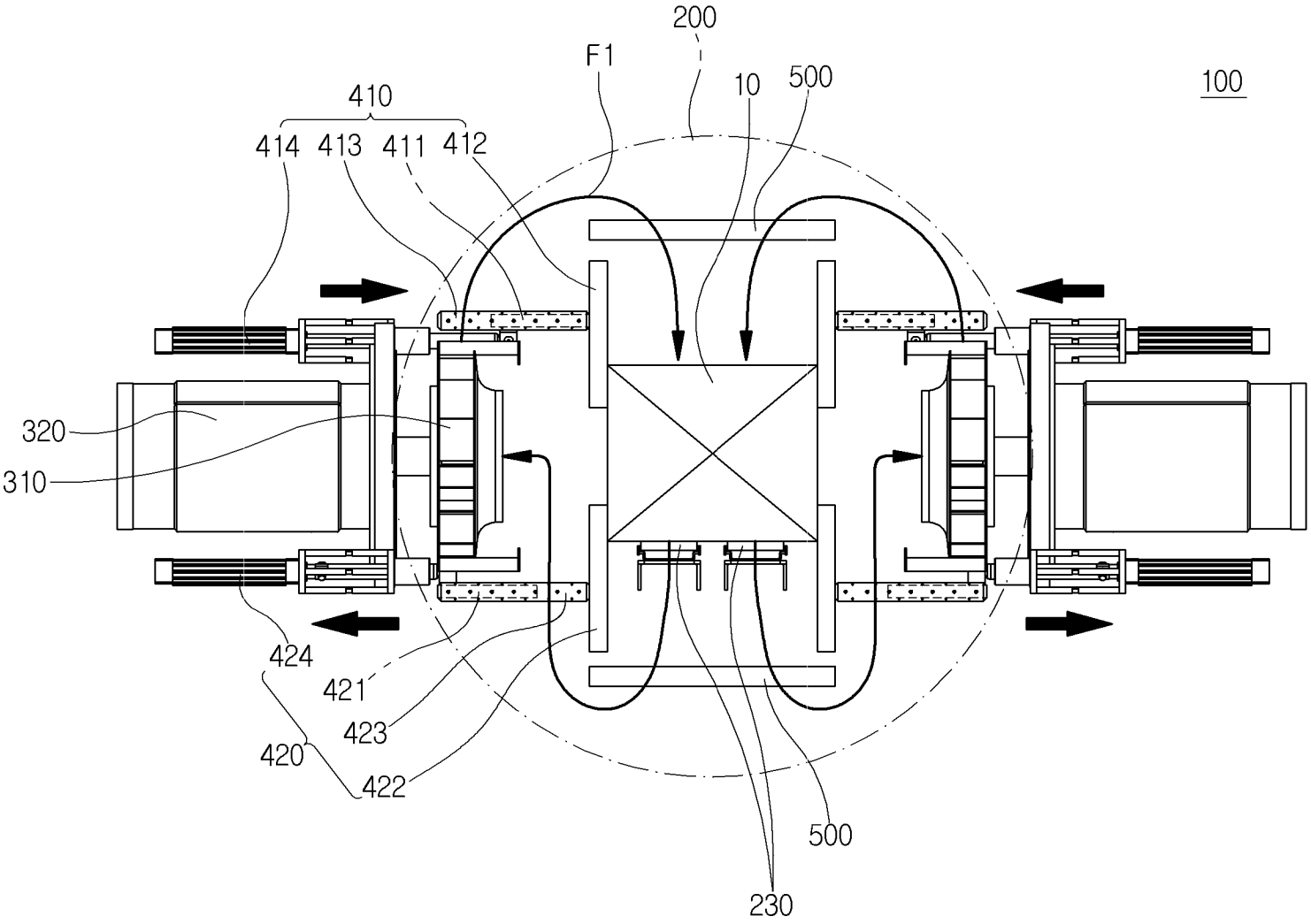

[Fig. 4]
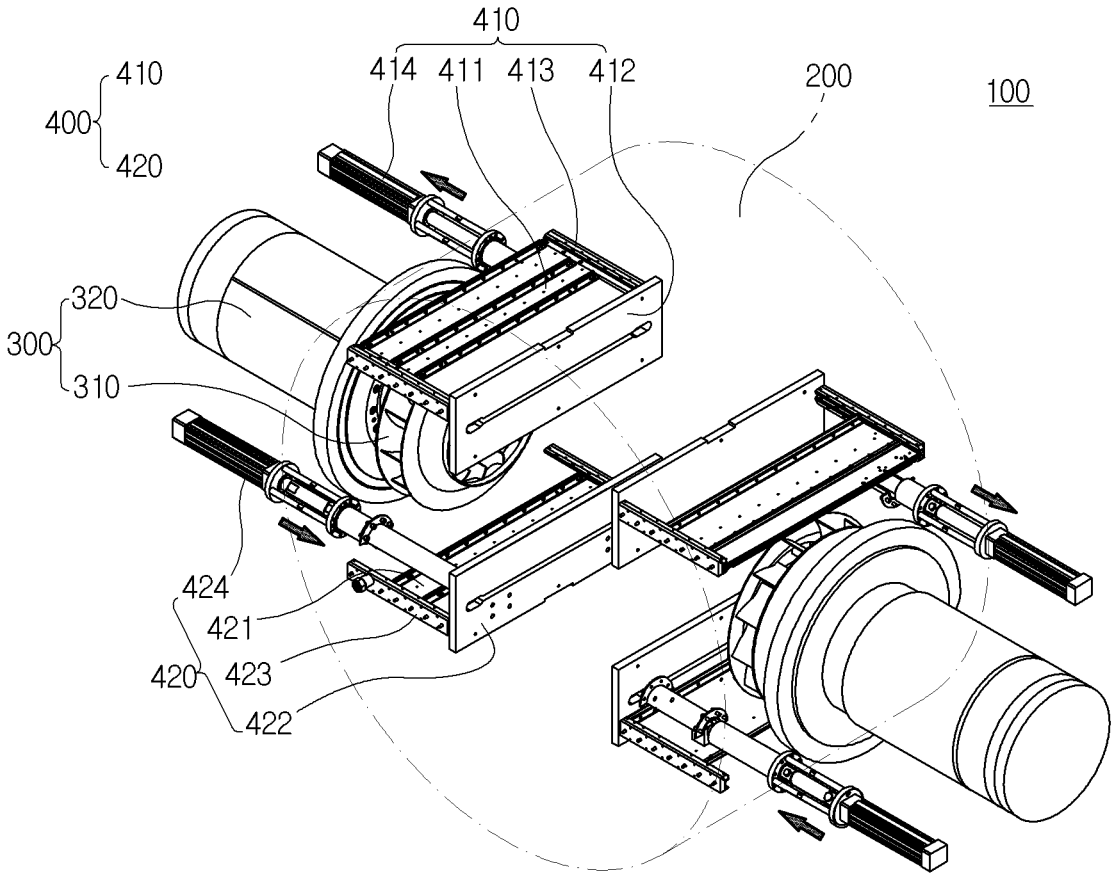

[Fig. 5]
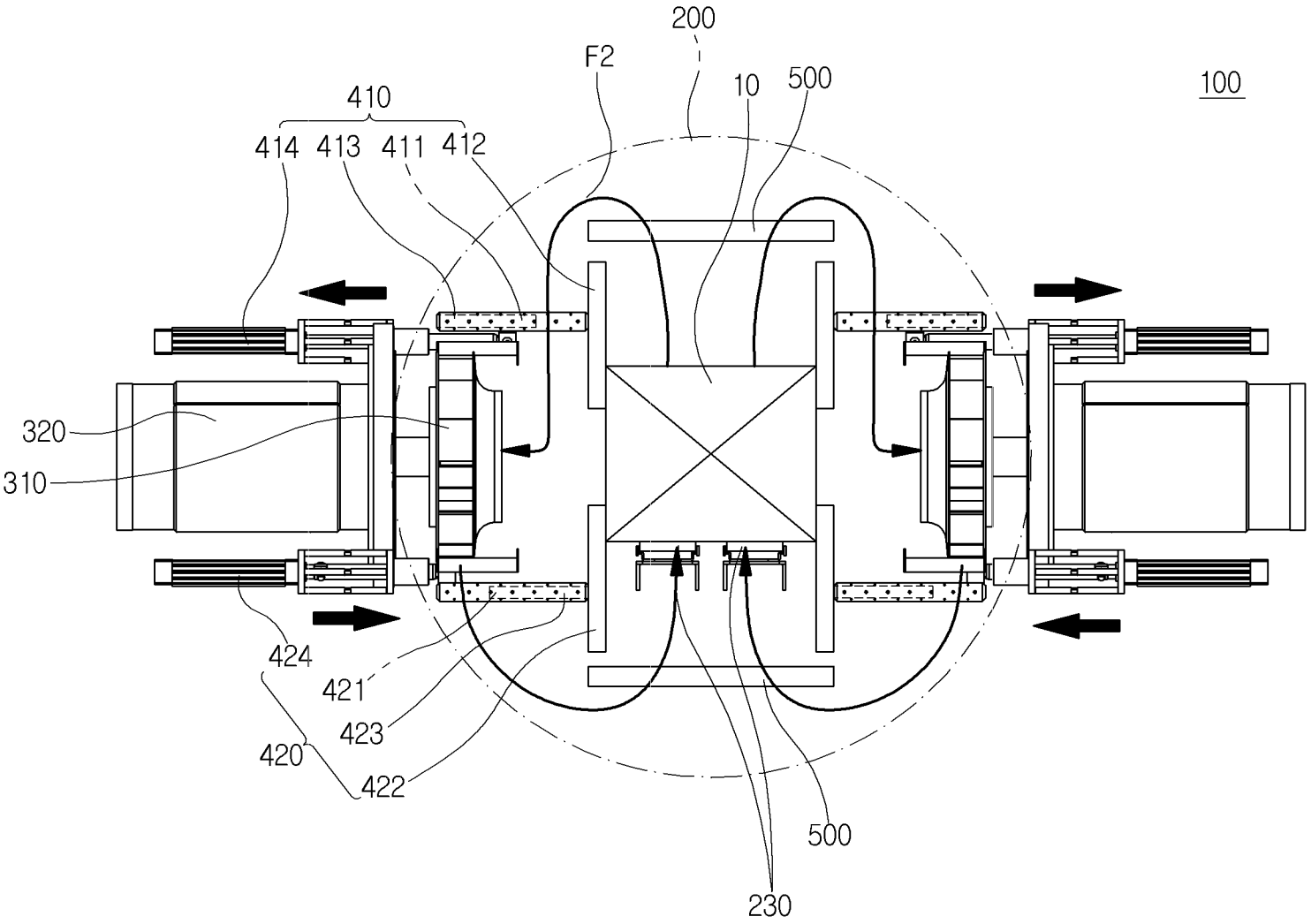

QUENCHING APPARATUS

CROSS-REFERENCE TO RELATED APPLICATIONS

This application is a 371 U.S. National Stage of International Application No. PCT/KR2017/001723, filed Feb. 16, 2017, which claims the benefit of and priority to Korean Patent Application No. 10-20160182374, filed Dec. 29, 2016. The entire disclosures of the above applications are incorporated herein by reference.

TECHNICAL FIELD

Exemplary embodiments of the present invention relate to a quenching apparatus, and more particularly, to a quenching apparatus capable of quickly reversing a flow of cooling gas flowing in a chamber.

BACKGROUND ART

Generally, a vacuum carburizing method has been successfully evaluated in terms of economic efficiency and quality improvement by remarkably shortening a carburizing time and securing uniformity of a carburizing layer. The vacuum carburization which is a high temperature carburizing process carried out under vacuum is usually performed at a high carburizing temperature of about 800° C. to 1100° C.

The vacuum carburizing method heats a treated product to a set carburizing temperature in a vacuum state, injects hydrocarbon gases such as methane and propane thereinto in the vacuum state to perform carburization with carbon produced during decomposition, again performs the diffusion processing thereon in the vacuum state, and then cooling it by an oil quenching or gas quenching method to repeat the carburization and diffusion processing to thereby making the desired carburizing layer, and then permeating the carbon thereinto while performing the carburization process in a short period of time to thereby obtain a predetermined amount of surface carbon.

European Patent No. 0535319 (hereinafter, referred to as 'Patent Document 1') discloses a vacuum carburizing apparatus capable of carrying out vacuum carburization. In the above patent document 1, the vacuum carburizing apparatus is configured to supply cooling gas to a vacuum chamber for vacuum carburization and operate a blower in one direction to move the supplied cooling gas and pass the supplied cooling gas through a heat exchanger, thereby cooling the treated product.

However, the flow of the cooling gas acts as a serious factor in the quenching process. However, in the above Patent Document 1, the cooling gas flows only in the same direction and thus the treated product is not cooled uniformly, which causes the problem in that the quenching is not smoothly performed and the quality of the treated product deteriorates.

DISCLOSURE

Technical Problem

An object of the present invention is to a quenching apparatus capable of quickly reversing a flow of cooling gas flowing in a chamber.

Technical Solution

In accordance with one aspect of the present invention, a quenching apparatus, includes: a chamber provided with a gas inlet and a gas outlet and having an object charged therein; a pair of flow generating means disposed on both sides of the chamber and generating a flow of gas in the chamber; and a flow direction reversing means disposed in the chamber and reversing a flow direction of gas to make the gas flow in any one of a first flow direction in which the gas flows from top to bottom of the object and a second flow direction in which the gas flows from the bottom to the top of the object.

The flow generating means may include: a centrifugal fan disposed in the chamber and sucking the gas into a central side by a centrifugal force and discharging the gas in a circumferential direction; and a driving motor disposed in the chamber and rotating the centrifugal fan.

The flow direction reversing means may include: an upper flow direction reversing means disposed at an upper portion of the centrifugal fan and opening or closing a circumferential upper portion of the centrifugal fan; and a lower flow direction reversing means disposed at a lower portion of the centrifugal fan and opening or closing a circumferential lower portion of the centrifugal fan.

The first flow direction may be formed by allowing the upper flow direction reversing means to open the circumferential upper portion of the centrifugal fan and the lower flow direction reversing means to close the circumferential lower portion of the centrifugal fan.

The second flow direction may be formed by allowing the upper flow direction reversing means to close the circumferential upper portion of the centrifugal fan and the lower flow direction reversing means to open the circumferential lower portion of the centrifugal fan.

The flow direction reversing means include: an upper plate disposed on the upper portion of the centrifugal fan and linearly moving between a closed position that is the circumferential upper portion of the centrifugal fan and an open position where it moves forward of the centrifugal fan to open the circumferential upper portion of the centrifugal fan; an upper support plate disposed in the chamber to be parallel with respect to the circumferential direction of the centrifugal fan and provided at a front of the upper plate so that an end of the upper plate comes into contact with the upper support plate when the upper plate moves to the open position; an upper guide rail disposed in the chamber and guiding the upper plate to linearly move; and an upper actuator disposed in the chamber and linearly moving the upper plate.

The lower flow direction reversing means may include: a lower plate disposed on the lower portion of the centrifugal fan to be parallel with the upper plate and linearly moving between a closed position that is the circumferential lower portion of the centrifugal fan and an open position where it moves forward of the centrifugal fan to open the circumferential lower portion of the centrifugal fan; a lower support plate disposed in the chamber to be parallel with respect to the circumferential direction of the centrifugal fan and provided at a front of the lower plate so that an end of the lower plate comes into contact with the lower support plate when the lower plate moves to the open position; a lower guide rail disposed in the chamber and guiding the lower plate to linearly move; and a lower actuator disposed in the chamber and linearly moving the lower plate.

The upper plate and the lower plate may be provided to have a size of a width corresponding to a thickness of the centrifugal fan and a moving distance corresponding to the size of the width when moving to the open position.

The quenching apparatus may further include: a heat exchanger disposed in the chamber to exchange heat with the flowing gas to cool the gas.

The heat exchange may be provided in pair to be disposed on upper and lower portions of the object, respectively.

Advantageous Effects

According to the quenching apparatus of the present invention, the quenching process may be more quickly performed by quickly reversing the flow of the cooling gas flowing in the chamber by the simple operation.

DESCRIPTION OF DRAWINGS

FIG. 1 is a perspective view schematically illustrating a quenching apparatus according to an embodiment of the present invention;

FIG. 2 is an exploded perspective view schematically illustrating an operating state in which gas flows in a first flow direction in the quenching apparatus according to the embodiment of the present invention;

FIG. 3 is a side view schematically illustrating an operating state in which gas flows in the first flow direction in the quenching apparatus according to the embodiment of the present invention;

FIG. 4 is an exploded perspective view schematically illustrating an operating state in which gas flows in a second flow direction in the quenching apparatus according to the embodiment of the present invention; and FIG. 5 is a side view schematically illustrating an operating state in which gas flows in a second flow direction in the quenching apparatus according to the embodiment of the present invention.

MODE FOR INVENTION

A quenching apparatus according to an exemplary embodiment of the present invention will be described in more detail in order to assist in understanding of the features of the present invention.

It is to be noted that in adding reference numerals to elements of each accompanying drawing, like reference numerals refer to like elements even though like elements are shown in different drawings. Further, in describing exemplary embodiments of the present invention, when it is determined that detailed description of known functions or configuration may obscure the gist of the present invention, the detailed description will be omitted.

Hereinafter, exemplary embodiments of the present invention will be described in detail with reference to the accompanying drawings.

FIG. 1 is a perspective view schematically illustrating a quenching apparatus according to an embodiment of the present invention, FIGS. 2 and 3 are a perspective view and a side view schematically illustrating an operating state in which gas flows in a first flow direction in the quenching apparatus according to the embodiment of the present invention, and FIGS. 4 and 5 are a perspective view and a side view schematically illustrating an operating state in which gas flows in a second flow direction in the quenching apparatus according to the embodiment of the present invention.

Referring to FIGS. 1 to 5, a quenching apparatus 100 according to an embodiment of the present invention includes a chamber 200 in which a gas inlet 210 and a gas outlet 220 are formed and in which an object 10 is charged, a pair of flow generating means 300 disposed on both sides of the chamber 200 to generate a flow of gas in the chamber 200, and a flow direction reversing means 400 disposed in the chamber 200 to reverse a flow direction of the gas to make the gas flow in any one of a first flow direction F1 in which the gas flows from top to bottom of the object 10 and a second flow direction F2 in which the gas flows from the bottom to the top of the object 10.

Here, although the object 10 is schematically illustrated in the drawing, it is a product to which a cooling process, i.e., a quenching process after heat treatment is to be applied and may be provided in any size and shape. Alternatively, a batch may also be provided to be charged in the chamber 200 in the state in which a plurality of products are seated in the batch of which the upper and lower parts are open.

The chamber 200 is provided in a cylindrical shape having a hollow portion and is provided with a object supporting part 230 so that the object 10 charged therein is seated and the flow generating means 300 and is configured to be provided with the flow generating means 300 and the flow direction reversing means 400.

Further, the chamber 200 is provided with a gas inlet 210 connected to an external gas supply line (not illustrated) to communicate with the inside of the chamber 200 to thereby supply gas to the chamber 200 and a gas outlet 220 connected to an external gas discharge line (not illustrated) to communicate with the inside of the chamber 200 to thereby discharge the gas in the chamber 200 to the outside.

Further, one side of the chamber 200 is provided with a door part 240 opening the inside of the chamber 200 to load or unload the object 10 into or from the inside of the chamber 200. Although the door part 240 is schematically illustrated in the drawing, the door part 240 may be provided in any form such as a sliding door or a revolving door.

The pair of flow generating means 300 is provided on both sides of the chamber 200, respectively and is provided to move the gas supplied to the inside of the chamber 200.

More specifically, the flow generating means 300 includes a centrifugal fan 310 disposed in the chamber 200 and sucking gas toward a center side thereof by a centrifugal force and discharging the gas in a circumferential direction thereof and a driving motor 320 disposed in the chamber 200 and rotating the centrifugal fan 310.

Here, one side of the centrifugal fan 310 is rotatably fastened to the driving motor 320 and is provided with a plurality of blades along the circumferential direction and a central side of the other side thereof is open to introduce gas thereinto.

By this configuration, when the centrifugal fan 310 is rotated by the driving motor 320, the gas is introduced into the center side of the centrifugal fan 310 and the gas is discharged in the circumferential direction by the centrifugal force.

The flow direction reversing means 400 is disposed in the chamber 200 and is provided to reverse the flow direction of gas to make the gas flow in any one of the first flow direction F1 in which the gas flows from the top to the bottom of the object 10 and the second flow direction F2 in which the gas flows from the bottom to the top of the object 10.

That is, when the gas flows in the chamber 200 due to the rotation of the centrifugal fan 310, the flow direction reversing means 400 may guide the flow direction of gas to move the gas in the first flow direction F1 or reverse the flow direction of the gas to move the gas in the second flow direction F2.

The flow direction reversing means 400 is provided in pair and disposed on each of the both sides of the chamber 200 where the flow generating means 300 is disposed, thereby guiding the flow of gas generated by the flow generating means 300 to a specific direction.

More specifically, the flow direction reversing means 400 includes an upper flow direction reversing means 410 disposed at an upper portion of the centrifugal fan 310 and opening or closing a circumferential upper portion of the centrifugal fan 310 and a lower flow direction reversing means 420 disposed at a lower portion of the centrifugal fan 310 and opening or closing a circumferential lower portion of the centrifugal fan 310.

For this purpose, when the upper flow direction reversing means 410 opens the circumferential upper portion of the centrifugal fan 310 and the lower flow direction reversing means 420 closes the circumferential lower portion of the centrifugal fan 310, as illustrated in FIGS. 2 and 3, gas flows in the first flow direction F1.

That is, since the circumferential lower portion of the centrifugal fan 310 is closed and the circumferential upper portion thereof is open, the gas discharged in the circumferential direction of the centrifugal fan 310 flows toward the upper portion of the centrifugal fan 310, the gas flowing upward from both sides of the chamber 200 is collected to be introduced into the upper portion of the object 10 while moving downward and then discharged to the lower portion after passing through the object 10, and the gas discharged to the lower portion of the object 10 flows to be introduced into the central side of the centrifugal fan 310 and discharged in the circumferential direction of the centrifugal fan 310 again.

Here, the upper flow direction reversing means 410 includes an upper plate 411 disposed on the upper portion of the centrifugal fan 310 in a direction perpendicular to the circumferential direction of the centrifugal fan 310 and linearly moving between a closed position that is the circumferential upper portion of the centrifugal fan 310 and an open position where it moves forward of the centrifugal fan 310 to open the circumferential upper portion of the centrifugal fan 310, an upper support plate 412 disposed in the chamber 200 to be parallel with respect to the circumferential direction of the centrifugal fan 310 and provided at a front of the upper plate 411 so that an end of the upper plate 411 comes into contact with the upper support plate 412 when the upper plate 411 moves to the open position, an upper guide rail 413 disposed in the chamber 200 and guiding the upper plate 411 to linearly move, and an upper actuator 414 disposed in the chamber 200 and linearly moving the upper plate 411.

By this configuration, if the upper actuator 414 is operated to be inserted, the upper plate 411 is positioned at the circumferential upper portion of the centrifugal fan 310 to close the flow of gas toward the circumferential upper portion of the centrifugal fan 310 and if the upper actuator 414 is operated to protrude, the upper plate 411 moves linearly to move forward from the circumferential upper portion of the centrifugal fan 310 when the end of the upper plate 411 comes into contact with the upper support plate 412 and is open to move gas toward the circumferential upper portion of the centrifugal fan 310.

Further, when the upper flow direction reversing means 410 closes the circumferential upper portion of the centrifugal fan 310 and the lower flow direction reversing means 420 opens the circumferential lower portion of the centrifugal fan 310, as illustrated in FIGS. 4 and 5, gas flows in the second flow direction F2.

That is, since the circumferential upper portion of the centrifugal fan 310 is closed and the circumferential lower portion thereof is open, the gas discharged in the circumferential direction of the centrifugal fan 310 flows toward the lower portion of the centrifugal fan 310, the gas flowing upward from both sides of the chamber 200 is collected to be introduced into the lower portion of the object 10 while moving upward and then discharged to the upper portion after passing through the object 10, and the gas discharged to the upper portion of the object 10 flows to be introduced into the central side of the centrifugal fan 310 and discharged in the circumferential direction of the centrifugal fan 310 again.

Here, the lower flow direction reversing means 420 includes a lower plate 421 disposed on the lower portion of the centrifugal fan 310 to be parallel with the upper plate 411 and linearly moving between a closed position that is the circumferential lower portion of the centrifugal fan 310 and an open position where it moves forward of the centrifugal fan 310 to open the circumferential lower portion of the centrifugal fan 310, a lower support plate 422 disposed in the chamber 200 to be parallel with respect to the circumferential direction of the centrifugal fan 310 and provided at a front of the lower plate 421 so that an end of the lower plate 421 comes into contact with the lower support plate 422 when the lower plate 421 moves to the open position, a lower guide rail 423 disposed in the chamber 200 and guiding the lower plate 421 to linearly move, and a lower actuator 424 disposed in the chamber 200 and linearly moving the lower plate 421.

By this configuration, if the lower actuator 424 is operated to be inserted, the lower plate 421 is positioned at the circumferential lower portion of the centrifugal fan 310 to close the flow of gas toward the circumferential upper portion of the centrifugal fan 310 and if the lower actuator 424 is operated to protrude, the lower plate 421 moves linearly to move forward from the circumferential lower portion of the centrifugal fan 310 when the end of the lower plate 421 comes into contact with the lower support plate 422 and is open to move gas toward the circumferential upper portion of the centrifugal fan 310.

Further, to effectively guide or block the flow of gas discharged in the circumferential direction from the centrifugal fan 310, the upper plate 411 and the lower plate 421 are provided to have a width corresponding to a thickness of the centrifugal fan 310 and has a moving distance corresponding to a size of the width when moving to the open position.

That is, the upper plate 411 and the lower plate 421 are provided to have the size of the width corresponding to the thickness of the centrifugal fan 310 to completely close the upper portion in the circumferential direction of the centrifugal fan 310 and the moving distance corresponding to the size of the width when moving to the open position corresponds to the width to completely open the circumferential upper portion of the centrifugal fan 310.

Furthermore, the quenching apparatus may further include a heat exchanger 500 disposed in the chamber 200 for exchanging heat with the flowing gas to cool the gas.

The heat exchanger 500 may be provided in pair and disposed at the upper and lower portions of the object 10, respectively, to exchange heat with the gas introduced into or discharged from the object 10, thereby cooling the gas.

Therefore, it is possible to simply reverse the flow direction of gas flowing in the chamber 200 by the linear movement between the upper plate 411 disposed at the upper portion of the centrifugal fan 310 and the lower plate 421 disposed at the lower portion of the centrifugal fan 310.

As described above, although the present invention has been described with reference to exemplary embodiments and the accompanying drawings, it would be appreciated by those skilled in the art that the present invention is not limited thereto but various modifications and alterations might be made without departing from the scope defined in the following claims.

The invention claimed is:

1. A quenching apparatus, comprising:

a chamber having two sides provided with a gas inlet and a gas outlet and having an object charged therein;

a pair of flow generating means disposed on both sides of the chamber and generating a flow of gas in the chamber; and a flow direction reversing means disposed in the chamber and reversing a flow direction of gas to make the gas flow in any one of a first flow direction in which the gas flows from top to bottom of the object and a second flow direction in which the gas flows from the bottom to the top of the object, wherein the flow generating means includes:

a centrifugal fan disposed in the chamber and sucking the gas into the chamber by a centrifugal force and discharging the gas in a circumferential direction; and a driving motor disposed in the chamber and rotating the centrifugal fan; and wherein the flow direction reversing means includes:

an upper flow direction reversing means disposed at an upper portion of the centrifugal fan and configured for opening or closing a circumferential upper portion of the centrifugal fan;

a lower flow direction reversing means disposed at a lower portion of the centrifugal fan and configured for opening or closing a circumferential lower portion of the centrifugal fan;

an upper plate disposed on the upper portion of the centrifugal fan and linearly moving between a closed position that is the circumferential upper portion of the centrifugal fan and an open position where it moves forward of the centrifugal fan to open the circumferential upper portion of the centrifugal fan;

an upper support plate disposed in the chamber to be parallel with respect to the circumferential direction of the centrifugal fan and provided at a front of the upper plate so that an end of the upper plate comes into contact with the upper support plate when the upper plate moves to the open position;

an upper guide rail disposed in the chamber and guiding the upper plate to linearly move; and an upper actuator disposed in the chamber and linearly moving the upper plate.

2. The quenching apparatus of claim 1, wherein the first flow direction is formed by the upper flow direction reversing means opening the circumferential upper portion of the centrifugal fan and the lower flow direction reversing means closing the circumferential lower portion of the centrifugal fan.

3. The quenching apparatus of claim 1, wherein the second flow direction is formed by the upper flow direction reversing means closing the circumferential upper portion of the centrifugal fan and the lower flow direction reversing means opening the circumferential lower portion of the centrifugal fan.

4. The quenching apparatus of claim 1, wherein the lower flow direction reversing means includes:

a lower plate disposed on the lower portion of the centrifugal fan to be parallel with the upper plate and linearly moving between a closed position that is the circumferential lower portion of the centrifugal fan and an open position where it moves forward of the centrifugal fan to open the circumferential lower portion of the centrifugal fan;

a lower support plate disposed in the chamber to be parallel with respect to the circumferential direction of the centrifugal fan and provided at a front of the lower plate so that an end of the lower plate comes into contact with the lower support plate when the lower plate moves to the open position;

a lower guide rail disposed in the chamber and guiding the lower plate to linearly move; and a lower actuator disposed in the chamber and linearly moving the lower plate.

5. The quenching apparatus of claim 4, wherein the upper plate and the lower plate are provided to have a size of a width corresponding to a thickness of the centrifugal fan and a moving distance corresponding to the size of the width when moving to the open position.

6. The quenching apparatus of claim 1, further comprising:

a heat exchanger disposed in the chamber to exchange heat with the flowing gas to cool the object.

7. The quenching apparatus of claim 6, wherein the heat exchanger is provided in pair and disposed on above and below the object support respectively.

* * * * *